US007475455B2

(12) United States Patent
Ishibashi et al.

(10) Patent No.: US 7,475,455 B2
(45) Date of Patent: Jan. 13, 2009

(54) FIBER-MADE SURFACE FASTENER FOR REDUCING UNPLEASANT NOISE AT PEELING-OFF AND PRODUCT PROVIDED THEREWITH

(75) Inventors: Akira Ishibashi, Toyama-ken (JP); Teiichi Murayama, Toyama-ken (JP); Mamoru Tanaka, Toyama-ken (JP); Shintaro Ohsugi, Toyama-ken (JP)

(73) Assignee: YKK Corporation, Tokyo (JP)

( * ) Notice: Subject to any disclaimer, the term of this patent is extended or adjusted under 35 U.S.C. 154(b) by 214 days.

(21) Appl. No.: 10/536,474

(22) PCT Filed: Nov. 13, 2003

(86) PCT No.: PCT/JP03/14470

§ 371 (c)(1),
(2), (4) Date: May 25, 2005

(87) PCT Pub. No.: WO2004/047581

PCT Pub. Date: Jun. 10, 2004

(65) Prior Publication Data

US 2006/0130293 A1 Jun. 22, 2006

(30) Foreign Application Priority Data

Nov. 26, 2002 (JP) ..... 2002-341930

(51) Int. Cl.
*A44B 18/00* (2006.01)

(52) U.S. Cl. ..... 24/442

(58) Field of Classification Search ..... 24/306, 24/442–452; 428/99, 100

See application file for complete search history.

(56) References Cited

U.S. PATENT DOCUMENTS

| | | | | | |
|---|---|---|---|---|---|
| 4,776,068 | A | * | 10/1988 | Smirlock et al. | 24/442 |
| 4,884,323 | A | * | 12/1989 | Provost et al. | 24/442 |
| 5,611,122 | A | * | 3/1997 | Torigoe et al. | 24/442 |
| 6,635,327 | B2 | * | 10/2003 | Ohira et al. | 428/68 |
| 7,152,283 | B2 | * | 12/2006 | Murayama et al. | 24/442 |

FOREIGN PATENT DOCUMENTS

| | | | |
|---|---|---|---|
| JP | 2-226023 A | * | 9/1990 |
| JP | 6-103 | * | 1/1994 |
| JP | P3083524 | * | 9/2000 |
| JP | 2002-253607 A | * | 9/2002 |

* cited by examiner

*Primary Examiner*—Robert J Sandy
*Assistant Examiner*—Ruth C Rodriguez
(74) *Attorney, Agent, or Firm*—Alston & Bird LLP

(57) ABSTRACT

This invention relates to a fiber-made surface fastener comprising joining faces each in which a plurality of fiber-made engaging elements are provided on one surface of each flat base fabric. By specifying a structure and composition yarns of the base fabric of the same surface fastener, the ratio (A/B) of an area A of a range in which sound spectrum of a peeling-off sound Fourier-transformed in a range of 100 Hz to 15000 Hz is 100 Hz to 3000 Hz to an area B of a range in which sound spectrum of a peeling-off sound Fourier-transformed in a range of 100 Hz to 15000 Hz is 3000 Hz to 15000 Hz is 0.4 or more. Consequently, tone of a sound generated when the surface fastener is peeled off and when the surface fastener attached on a product is peeled off is shifted to a low tone side so as to reduce an uncomfortable sound to a lower tone thereby reducing a feeling of discomfort.

12 Claims, 6 Drawing Sheets

FIBER-MADE SURFACE FASTENER FOR REDUCING UNPLEASANT NOISE AT PEELING-OFF AND PRODUCT PROVIDED THEREWITH

TECHNICAL FIELD

The present invention relates to a fiber-made surface fastener and a surface fastener attached product provided with the surface fastener and more particularly to a fiber-made surface fastener for reducing a peeling-off sound and a product provided with the surface fastener.

BACKGROUND ART

As regards a method for reducing the peeling-off sound of the surface fastener, for example, two US patents have been already publicized. According to U.S. Pat. No. 4,776,068 specification (Quiet Touch Fastener Material (1986)), which is one of the two US patents, by forming a tape which is a base fabric of the surface fastener in a lattice structure, propagation of energy into the air is intended to be reduced. Further, U.S. Pat. No. 4,884,323 specification (Quiet Touch Fastener Attachment System) (1989)), which is the other of the two US patents, has disclosed a method in which a mounting member is provided between a surface fastener member and cloth, which is an attachment object, so as to isolate the cloth and the surface fastener via the mounting member and a method in which sound absorptive material is attached to a rear face of the surface fastener member to increase a volume of the base fabric itself, thereby suppressing vibration at a time of peeling-off. According to these methods, the surface fastener is attached by sewing only its edge portions while there is no factor for fixing the surface fastener to the cloth in a central portion. Thus, this is not suitable for mounting a wide surface fastener and if another sound absorptive material is attached to a rear face of the cloth, the volume of the base fabric at a portion in which the surface fastener is to be mounted increases and its appearance beauty and touch feeling drop, thereby providing an extremely disharmonious feeling. Further, there is another problem that sewing method becomes complicated, which increases production process.

Japanese Patent Application Laid-Open No. 6-103 has disclosed a surface fastener having vibration absorptive material on a rear surface of its base fabric. To secure a sufficient effect according to this method, a weight of the vibration absorptive material needs to be sufficient and thus, there is a disadvantage that the surface fastener becomes thick. Further, these technologies intend to reduce a loudness of the peeling-off sound. However, there are uncomfortable sound and not uncomfortable sound for a hearing of a human being. It cannot be said to be sufficient if the sound is simply reduced and it is important not to make a human being feel uncomfortable in his hearing.

When the surface fastener is peeled off, a relatively large abnormal sound occurs. This abnormal sound is a sound generated by vibration of the base fabric. When individual engaging elements are peeled off, the sound is always generated and it is difficult to completely eliminate the generation of this sound.

According to the aforementioned patent documents 1-3, the generated sound is reduced with the methods for reducing a ratio of the propagation of the vibrations of the base fabric to the air. However, these methods do not take into account a tone of the sound and when the tone makes human being feel uncomfortable even if the generated sound is reduced, it cannot be said that the product is satisfactory. Further, if the surface fastener is sewed onto a product, the tone changes.

Thus, it is necessary to consider a change of the tone not only in the surface fastener but also in an entire product with the surface fastener attached.

An object of the present invention is to provide a fiber-made surface fastener in which the tone of the peeling-off sound generated from the surface fastener itself is shifted to a low tone side to reduce a feeling of discomfort while the peeling-off sound generated by a product on which the surface fastener is attached is shifted to a low tone side in order to suppress a feeling of discomfort, and a product provided with the surface fastener.

DISCLOSURE OF THE INVENTION

According to the present invention, attention is paid to the tone of a sound generated when the surface fastener is peeled off and it is intended to reduce a component which provides a feeling of discomfort by comparing with sound spectrum obtained by Fourier transformation while, at a same time, reducing the generated sound itself so as to eliminate the feeling of discomfort. Additionally, means for suppressing a frequency of the peeling-off sound is developed.

According to the above-mentioned U.S. Pat. No. 4,776,068 specification, the base fabric of the surface fastener is constructed of a lattice structure so as to reduce efficiency of the vibration being transmitted to the air and additionally, material having a mass is attached to the rear face to secure silence. According to the U.S. Pat. No. 4,884,323 specification, a mounting system is provided on the rear face and the base cloth on which the surface fastener is mounted and the base fabric of the surface fastener are separated to prevent the vibration from being transmitted from the base fabric to the base cloth.

As a result of experiments by inventors, it has been found that the abnormal sound from the surface fastener is generated when base fabrics of the surface fastener in which the engaging elements engage each other restores their original states instantly after the base fabrics are pulled intensely by hooks and loops and then these engagements are released. It is considered that the vibration is transmitted to the air like a speaker cone and propagated as a sound at this time. The lattice-like structure disclosed in the U.S. Pat. No. 4,776,068 is equivalent to making a hole in the speaker cone thereby suppressing the efficiency of the vibration being transmitted to the air.

The methods disclosed in the above-mentioned U.S. Pat. No. 4,776,068 specification, U.S. Pat. No. 4,884,323 specification and Japanese Patent Application Laid-Open No. 6-103 paid attention to only reducing the sound and the tone of the sound is not considered at all. The sound generated when the surface fastener is peeled off is discrete, sharp, and attenuated quickly. Generally these sounds are unpleasant sounds. If a high frequency component is removed from such a sound, the tone of the sound is changed to a mellow one.

It is convenient to use sound spectrum to compare these sounds. The sound spectrum is expressed with a frequency and intensity placed on a horizontal axis and a vertical axis respectively. The sound spectrum is obtained by Fourier transformation. Usually, fast Fourier transformation (FFT) is carried out with a computer. The FFT needs data of a factorial number of 2 and its resolution depends on a quantity of data. A lowest frequency which can be analyzed is determined depending on a sampling time. A highest frequency is determined depending on a sampling cycle. Therefore, when discussing the sound spectrum, it is important to indicate an analysis range. Usually, for the sound spectrum, its abscissa axis and ordinate axis are expressed with logarithm.

A first basic structure of the present invention exists in a surface fastener including joining faces each in which a plurality of fiber-made engaging elements are provided on one surface of each flat base fabric comprising fiber structural material, wherein a ratio (A/B) of an area A of a range in which sound spectrum of a peeling-off sound Fourier-transformed in a range of 100 Hz to 15000 Hz is 100 Hz to 3000 Hz to an area B of a range in which sound spectrum of a peeling-off sound Fourier-transformed in a range of 100 Hz to 15000 Hz is 3000 Hz to 15000 Hz is 0.4 or more.

According to an experiment by the inventors, it has been found that, by comparing areas before and after 3000 Hz as a reference in a frequency range of 100 Hz to 150000 Hz, the tone of the sound can be evaluated. A peeling-off sound including a lot of high frequencies of 3000 Hz or more is unpleasant and gives a feeling of discomfort while a mellow sound is produced if that component is small. When the ratio (A/B) of the area A of a range in which sound spectrum of a peeling-off sound Fourier-transformed is 100 Hz to 3000 Hz to the area B of a range in which sound spectrum of a peeling-off sound Fourier-transformed is 3000 Hz to 15000 Hz is 0.4 or less, the peeling-off sound is felt to be unpleasant and uncomfortable.

Further, if a maximum component of sound spectrum of the peeling-off sound Fourier-transformed in a range of 100 Hz to 15000 Hz is a frequency lower than 3000 Hz, the peeling-off sound is never felt to be uncomfortable. Particularly, if in the surface fastener including joining faces each in which a plurality of fiber-made engaging elements are provided on a one surface of each flat base fabric, the ratio (A/B) of the area A of the range in which sound spectrum of the peeling-off sound Fourier-transformed in the range of 100 Hz to 15000 Hz is 100 Hz to 3000 Hz to the area B of the range in which sound spectrum of the peeling-off sound Fourier-transformed in the range of 100 Hz to 15000 Hz is 3000 Hz to 15000 Hz is 0.4 or more and the maximum component of sound spectrum of the peeling-off sound Fourier-transformed in the range of 100 Hz to 15000 Hz is the frequency lower than 3000 Hz, the generated sound is not unpleasant and hardly uncomfortable.

The present invention has been accomplished based on a finding that a hardness of the surface fastener base fabric affects the tone of a generated sound. When the base fabric of the surface fastener is composed of a more flexible base fabric and further, it is provided with gaps, the tone of a sound generated at a time of peeling-off can be shifted to low frequency side so that the uncomfortable sound at the time of peeling-off can be converted to a mellow sound.

More specifically, if a density of the base fabric of the surface fastener is reduced, the base fabric is softened, an elasticity of the base fabric is reduced and transmission of the vibration of the high frequency component is reduced, the generated sound is shifted to the low frequency side. Further, as a method for reducing the transmission of the vibration of a high tone sound in the base fabric, it is effective to adopt a fabric as largely curved as possible without placing yarns constituting the base fabric linearly. It is further effective if the density of the base fabric, particularly an apparent density is reduced to 0.5 g/cm$^3$ or less at a same time.

When the base fabric of each of male/female surface fastener members is bent at 180° in a radius of 4.0 mm, a sum of bending strength of both base fabrics is 36 gf·cm/2.5 cm or less and a joining face of at least one surface fastener member comprises a plurality of fiber-made engaging elements distributed uniformly on an entire surface, the generated sound can be shifted to the low frequency side by reducing the transmission of the vibration of the high frequency component.

When the elasticity is high, a characteristic vibration exists on a high tone side and if the elasticity is low, the characteristic vibration is shifted to the low frequency side. As for the base fabric of the surface fastener, if the base fabric is hard, a high tone is generated and if the base fabric is soft, a low tone is generated. The aforementioned methods for bending yarns or reducing the density is effective for softening the base fabric of the surface fastener to shift the generated sound to a low tone side.

The vibration can be classified into a transverse wave and a longitudinal wave. The transverse wave is a vibration at right angle with respect to a longitudinal direction of a yarn. This vibration is attenuated easily by friction with an adjoining yarn or back coating material. If a vibration attenuating material or the like is provided, it is attenuated further effectively. On the other hand, the longitudinal wave is a wave vibrating in the longitudinal direction of the yarn. A propagation velocity of this wave is determined by storage elastic modulus and attenuating is determined by loss elastic modulus. A ratio of the storage elastic modulus to the loss elastic modulus is usually 10:1 at room temperature and the attenuating is not so large at the room temperature. A method of bending the yarn is effective for attenuating the longitudinal wave. Part of energy of the longitudinal wave is converted to the transverse wave by bending and the longitudinal wave is attenuated quickly at each time of the bending.

To increase an attenuating effect, a bending angle of the yarn is preferably 90° or more. In a case of a weaving structure in which the bending of the yarn is small like a plain weaving, the vibration is not attenuated but distributed in a wide area. On the other hand, in a case of a structure in which the yarn is bent largely like a knitting structure, the vibration is attenuated by the bending of the yarn and the vibration is confined to a small area. It is particularly effective when the yarn is bulky. Also, when the apparent density of the weaving/knitting structure is 0.5 g/cm$^3$ or less, the knitting yarn is bent largely and flexible and its attenuating effect is great at a same time.

When yarns are bent so that there is a gap among the yarns, the high frequency component is attenuated quickly while only low frequency component remains. Thus, a central frequency is shifted to the low frequency side. Further, such a base fabric is entirely flexible and the elasticity is low and therefore, the characteristic vibration is shifted to the low frequency side.

To reduce the density of the base fabric, a method of roughening the weaving/knitting structure is effective. In case of knitting, when a repetitive number (wale density) in a transverse direction is N1 (number of times/cm) and the repetitive number (course density) in a longitudinal direction is N2(time/cm), if N1+N2 is assumed to be 5.9 or more and 29.0 or less, the above-described condition is satisfied and the peeling-off sound can be reduced. In a case of weaving, when for example, a weft yarn density is 18 times/cm or less, a warp yarn density is 37.5 pieces/cm or less, a size of the weft yarn is 140-300 denier, a size of the warp yarn is 140-300 denier, and a size of a loop yarn is 450 denier, the above-described condition can be satisfied.

As a method for adjusting a bulkiness of the yarn to reduce the density, it is permissible to use a crimped yarn. The crimped yarn itself has a bulkiness and thus the bulkiness of a woven/knitted fabric is increased, thereby decreasing the apparent density. In the weaving/knitting structure, if part of composition yarns is woven or knitted in a form of a loop at a time of weaving or knitting, the apparent density is further reduced. Therefore, a sound of high frequency generated when the surface fastener is peeled off is shifted to the low frequency side effectively and uncomfortable sound is converted into the mellow sound.

A ratio of the storage elastic modulus to the loss elastic modulus of the yarn can be improved by a mix spinning. Particularly if a yarn of material having a Tan Delta peak around the room temperature like a urethane fiber is mixed when spun, the loss elastic modulus of the yarn is raised remarkably. Further, material whose glass transition point is at low temperature and crystallinity index is small like LDPE (low-density polyethylene) is also effective. If the loss elastic modulus is raised as described above, the high tone sound is absorbed effectively and the sound generated at the time of peeling-off is shifted to the low tone side. If the base fabric is formed in a lace-like structure, yarns transmitting the vibration are bent in multiple layers and a number of yarns for transmitting the vibration is decreased, so that the apparent density drops, which is further effective.

The sound generated when the surface fastener is peeled off is not generated from only the surface fastener, but the vibration is transmitted to a product to which it is attached and the sound is also generated from the product. Thus, it is insufficient even if the sound from the surface fastener is reduced, and it is necessary to consider the characteristic of the product. Even if a same type of the surface fastener is used, the generated sound differs depending on a mating cloth on which it is sewed. To eliminate such a difference, it is effective to interpose a spacer having gap forming means between the base fabric of the surface fastener and the mating cloth to be sewed so as to have a structure in which no vibration is transmitted to cloth. In this case, it is effective to insert a cloth having the characteristic of softening the sound as a spacer. As the spacer, fabric whose apparent density is 0.5 $g/cm^3$ or less is suitable like the base fabric of the surface fastener and for the same reason as the base fabric of the surface fastener, it plays a role of shifting the vibration to the low frequency side.

As a result of measuring a difference between the peeling-off sounds when the surface fastener is attached to a base cloth via a spacer and when it is attached directly to the base cloth, the peeling-off sound of a test piece sewed via the spacer is evidently shifted to the low frequency side. Therefore, the generation of the unpleasant sound at the time of peeling-off is suppressed. Further, a high frequency component ratio (A/B) is larger in the test piece attached directly to the base cloth than in the test piece sewed to the base cloth via the spacer. The maximum component of sound spectrum of the test piece sewed directly to the base cloth spreads widely to the high frequency side and the maximum component of sound spectrum of the test piece sewed to the base cloth via the spacer is concentrated to low frequencies. Thus, the peeling-off sound of the test piece in which the surface fastener is sewed to the base cloth via the spacer is low and does not provide a feeling of discomfort.

Providing vibration attenuating means between the rear face of the base fabric from which the engaging elements of the surface fastener are raised and the attachment object is also effective. As this vibration attenuating means, various kinds of fabrics whose bending strength is 0.7 gf·cm/2.5 cm or less when it is bent at 180° in the radius of 4 mm are preferred or various kinds of fabric whose apparent density is 0.5 $g/cm^3$ or less may be adopted.

When the surface fastener in which such uncomfortable sound is reduced is used on clothes, no feeling of discomfort is accompanied when the surface fastener is fastened or unfastened and thus, it is preferable. As application for general clothing, this is available for handicapped person's simple fastening underwear, shoulder pad, underwear, uniform, working clothes, ski wear, jumper, trousers, pants, skirt, dress, slacks, belt and the like. For those in which fastening/unfastening is carried out frequently such as gloves and pocket cover, the generation of no unpleasant sound is important from a viewpoint of comfortable use. The surface fastener of the present invention can be used preferably for such applications.

Using the surface fastener of the present invention enables various kinds of bags, business bags, purses and the like to be opened/closed without a care about an opening/closing at a silent place. Particularly, for a duffel bag, bag, vest, jacket, clothing, gun holder, sleeping bag or the like for military use or hunting use in which the generation of sound is problematic, the surface fastener of the present invention is preferred. If it is applied to underwear, combination underwear, diaper, diaper cover, wrapper, coverall for a newborn baby or an infant, changing of clothing or a diaper can be carried out without a care of generated sound at sleeping time.

A stationery case and the like need to be opened or closed at a silent place like a classroom and a library and the sound is an important factor. This is suitable for various kinds of a document holder, pen case, binding band, system notebook and the like used at such a place. Further, the surface fastener is often used in various kinds of medical products. The surface fastener is used in an arm band for blood pressure measurement, supporter, connection of artificial limb or artificial leg, belt of nightclothes, fixing of joint portion of nightclothes, pillow cover, sheet and the like and a product in which unpleasant noise is generated when it is peeled off is not liked. The surface fastener is used in shoes such as athletic shoes and for such applications, the surface fastener accompanying no uncomfortable sound can be used.

Further, the surface fastener is used for various kinds of electronic devices. For this case, video camera, CD player, camera, camera lens and the like can be mentioned. The surface fastener of the present invention can be used preferably for these kinds of products. It can be also used for a headrest cover, sheet cover, curtain belt for an automobile and the like. Further, the surface fastener of the present invention is preferably used for preventing a slip of a carpet, and for fixing the curtain belt and wallpaper.

BEST MODE FOR CARRYING OUT THE INVENTION

Hereinafter, a preferred embodiment of the present invention will be described specifically with reference to accompanying drawings.

Figure 1:
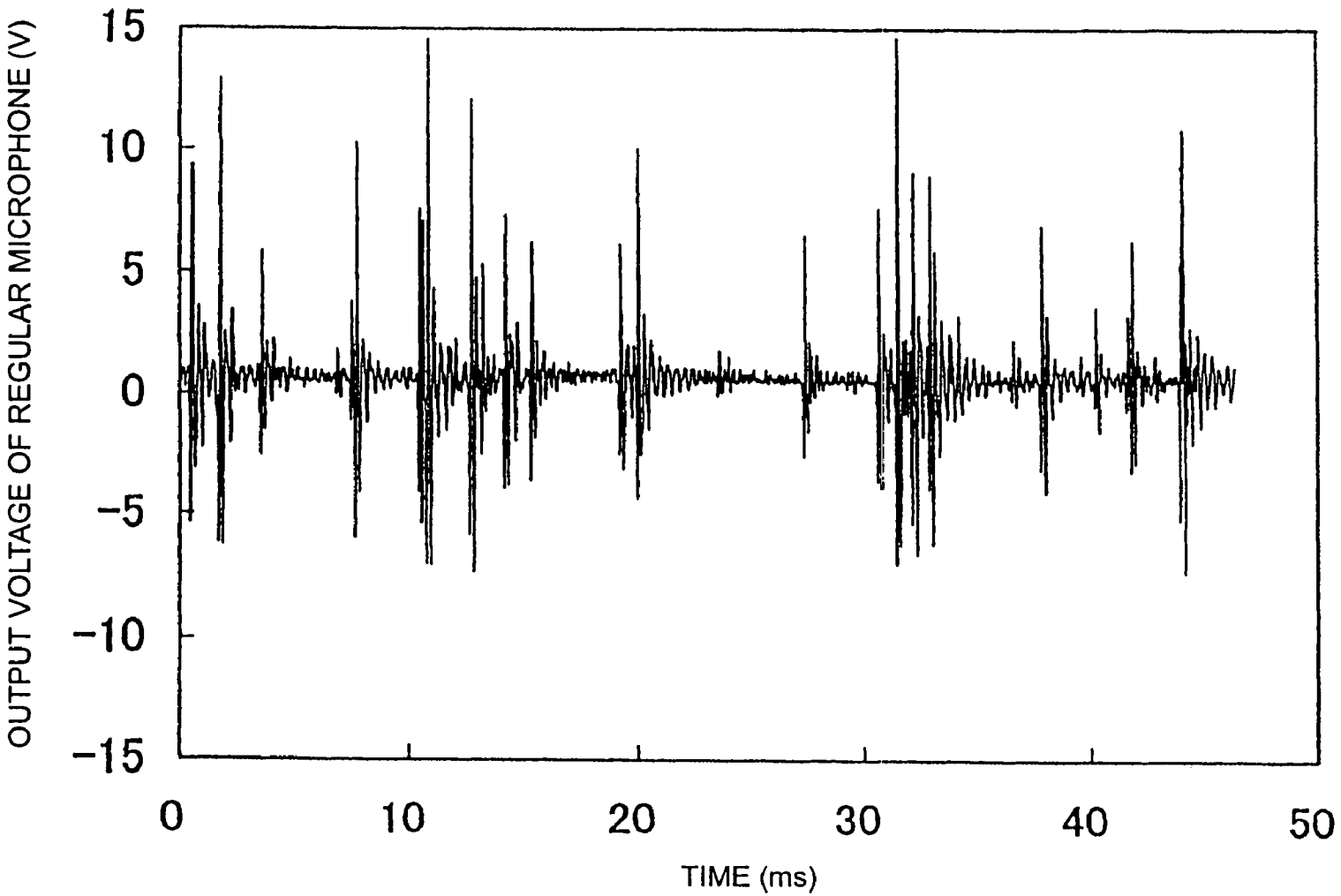
FIG. 1 is a characteristic diagram relating to time and on output of a sound generated when the surface fastener is peeled off.
Figure 2:
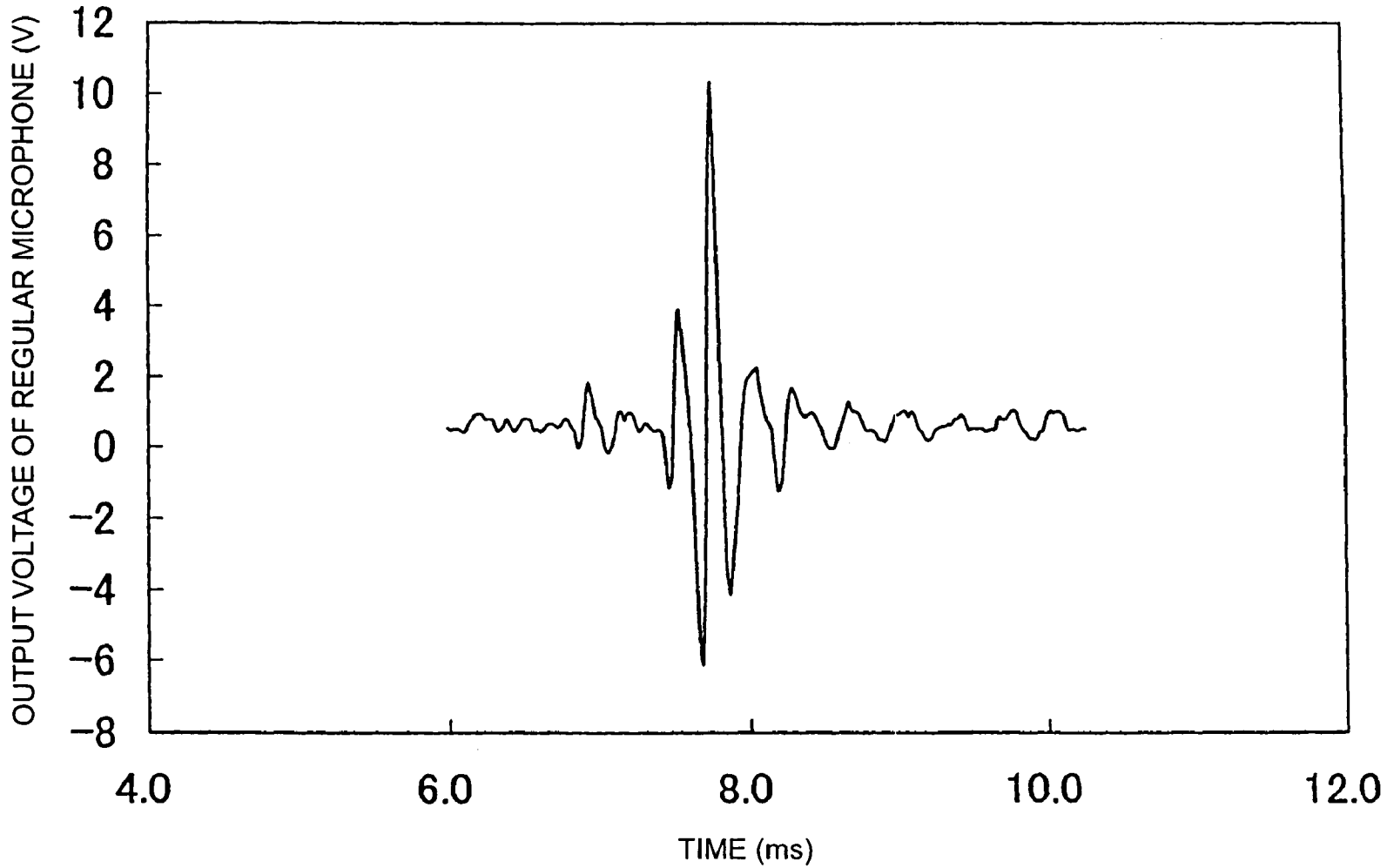
FIG. 2 is a characteristic diagram showing part of FIG. 1 in enlargement.

A sound generated when the surface fastener is peeled off is a sound whose waveform is as shown in FIG. 1. As understood from the same Figure, the sound generated at this time is a discrete, sharp, quickly attenuated sound. FIG. 2 shows a sound of that kind in enlargement. As understood from FIG. 2, a single peeling-off sound is a sound having a high frequency, which is attenuated instantaneously in as short a time as 0.1 second. Generally, such kind of sound is an uncomfortable sound. If a high frequency component is removed form this sound, a tone of the sound changes to a soft sound.

Figure 3:
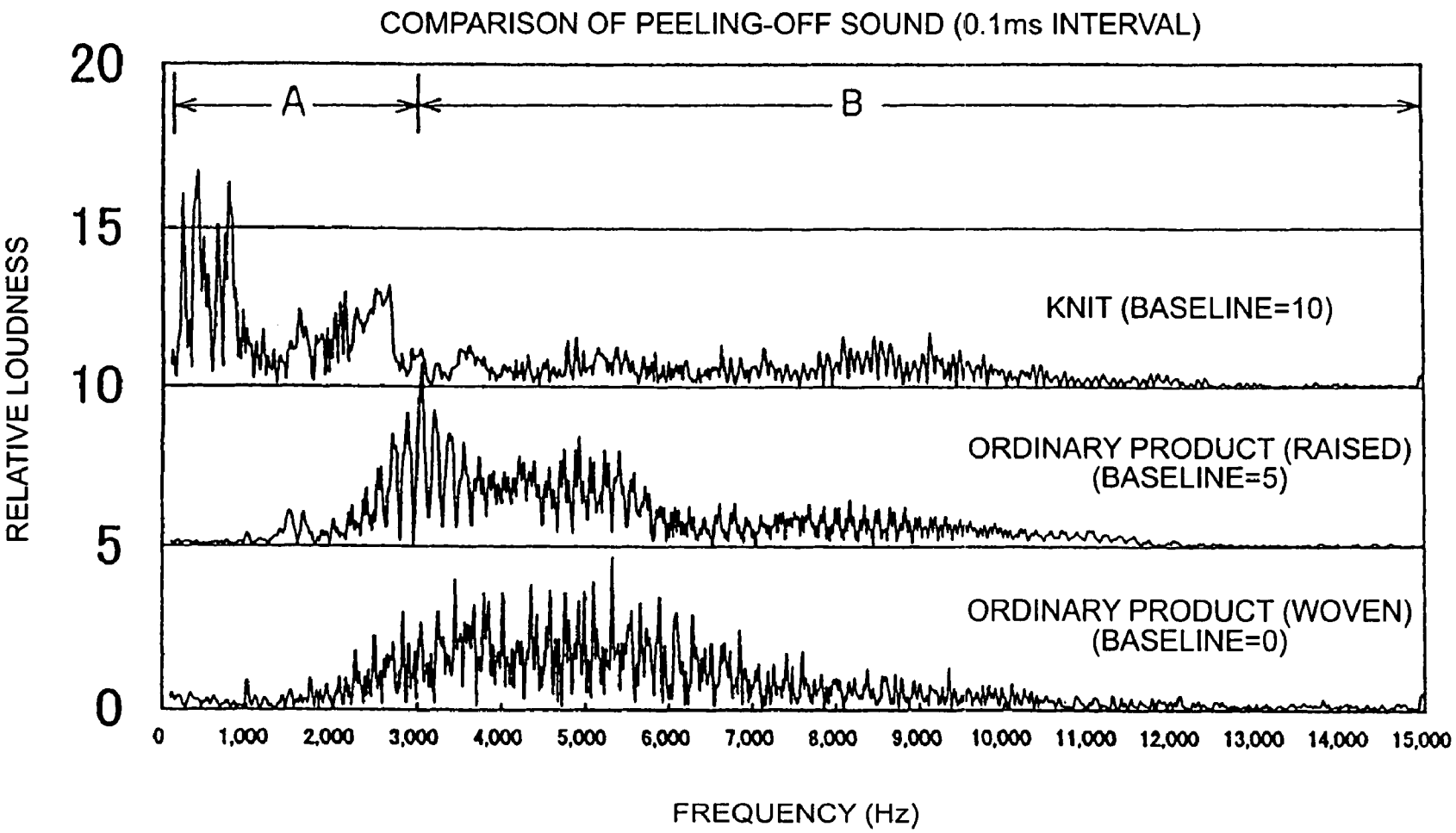
FIG. 3 is a comparative characteristic diagram of frequency and relative loudness indicating differences in sound generated at a time of peeling-off depending on a base fabric structure of the surface fastener by comparison.

FIG. 3 shows a result of measurement of the peeling-off sound of a sample in Table 1. For this measurement, a microphone was placed far by 65 mm from a fiber-made surface fastener and a sound generated when it was peeled off was measured. An ordinary product (woven) among base fabric structures shown in the same Table is a woven fabric having a structure similar to plain weaving. An ordinary product (raised) in the same Table is a raised woven fabric. On the other hand, a knit is composed of a warp knitting structure and its apparent density is low and its composition yarns are bent largely due to a knitting structure. If the knitting structure is adopted, effects of apparent density and yarn bending reflect synthetically so that the generated sound is shifted largely to a low tone side.

When an area obtained by numerically integrating components of 3000 Hz or less in a frequency of a sound generated when the surface fastener is peeled off is assumed to be A while an area obtained by numerically integrating components of 3000 Hz or more is assumed to be B, a value of a ratio A/B is called as a high frequency component ratio. If this high frequency component ratio is 0.4 or more, the sound is not felt as uncomfortable. The high frequency component ratio of each sample shown in FIG. 3 was 0.164 for an ordinary woven product, 0.204 for raised fabric (raised), and 1.075 for a knit product. A maximum component of sound spectrum was 5330 Hz for an ordinary product (woven), 3070 Hz for an ordinary product (raised) and 420 Hz for a knit product. In case of the knit product, its peeling-off sound was evidently heard as a lower tone than other samples and was not felt as uncomfortable.

TABLE 1

| Fabric base structure | Material | Apparent density (g/cm$^3$) |
|---|---|---|
| Ordinary product (woven) | N6 | 0.55 |
| Ordinary product (raised) | N6 | 0.55 |
| Knit | N6 | 0.45 |

According to the present invention, by lowering a density of the base fabric of the surface fastener, softening the base fabric, reducing an elasticity of the base fabric and lowering propagation of vibration of a high frequency component, the generated sound is shifted to a low frequency side securely. More specifically, as a method for lowering the propagation of the vibration of a high note sound in the base fabric, it is effective to adopt a structure bent as largely as possible without placing yarns constituting the base fabric linearly. Further, if the density of the base fabric is reduced so that its apparent density is set to 0.5 g/cm$^3$ or less, it is further effective.

The vibration is classified into a transverse wave and a longitudinal wave. In order to attenuate the longitudinal wave, it is effective to bend yarns. Part of energy of the longitudinal wave is transformed into the transverse wave by a bending so that the longitudinal wave is attenuated quickly at each time of the bending. To raise this attenuating effect, it is desirable that the bending angle of the yarns is 90° or more. In case of a weaving structure having a small bending like plain woven fabric, the vibration is distributed in a wide area without being attenuated. On the other hand, in a structure in which yarns are bent largely like a knitting structure, the vibration is attenuated due to bending of the yarns and the vibration is confined within a small area.

Particularly, if the yarns are bulky, the effect is great. Also, if the apparent density of the weaving/knitting structure is 0.5 g/cm$^3$ or less, its attenuating effect is great. If the elasticity is high, a characteristic vibration is located on a high tone side and if the elasticity is low, the characteristic vibration is shifted to a low frequency side. As regards the base fabric of the surface fastener, if the base fabric is hard, a high tone is generated and if the base fabric is flexible, a low tone is generated. As described above, a method for bending the yarns, reducing the density or the like is effective for softening the base fabric of the surface fastener and the generated sound is shifted effectively to the low tone side.

Figure 4:
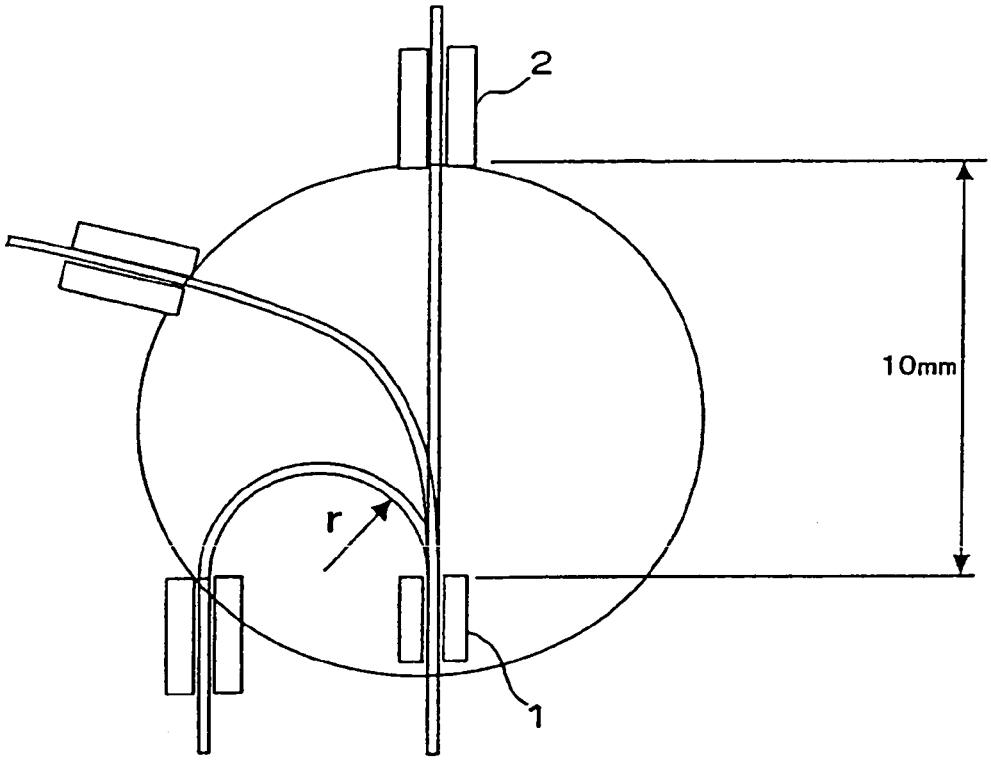
FIG. 4 is a schematic explanatory diagram of a measuring mechanism for bending strength of a base fabric of the surface fastener.

Hardness of the base fabric of the surface fastener can be obtained as a force necessary for the bending with a forward bending machine (KES-F2, manufactured by KATO TECH CO., LTD.). The KES-F2 operates as shown in FIG. 4. A fixed chuck 1 and a movable chuck 2 are disposed with a predetermined interval and a sample whose two ends are sandwiched by the fixed chuck 1 and the movable chuck 2 is bent as the movable chuck 2 moves on a trajectory having a specific curvature. That is, the movable chuck 2 moves with its neck swinging so as to maintain the specific curvature (1/r). A minimum curvature of a measurable sample is 4 mm. A moment applied to the fixed chuck 1 when the curvature is 4.0 mm is measured according to such a method and flexibility of the base fabric is evaluated. With a bending angle set to 180°, bending strength of the sample was measured. Data was converted in terms that a width was 25 mm and then, the bending strength per 25 mm was compared.

Figure 5:
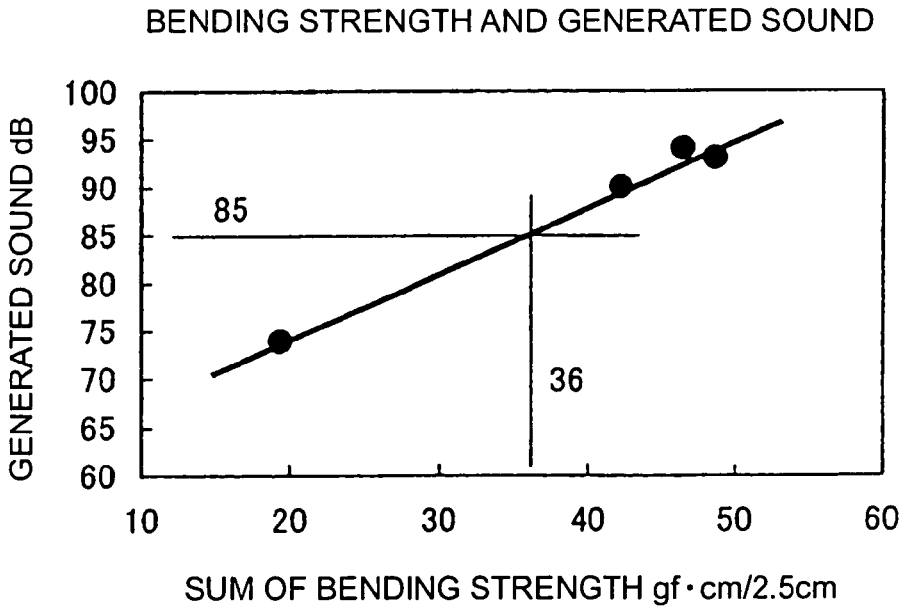
FIG. 5 is a correlation diagram of bending strength of a base fabric and a generated sound.

As for male/female surface fastener members, their engaging elements are cut out and the bending strength of only the base fabrics were measured according to the above-described method. As the bending strength, a sum of measured values of the base fabrics of the male/female surface fastener members was adopted. A generated sound was measured with a sound-level meter placed at a distance of 65 mm from a sample. As for a result, as the bending strength increased, the generated sound increased as shown in FIG. 5. In case of an ordinary surface fastener, the sum of its bending strength was 46 gf·cm/2.5 cm and the generated sound when it was peeled off was 95 dB. Contrary to this, if the sum of the bending of the base fabrics was set to 19 gf·cm/2.5 cm, it dropped to 75 dB. If a 10 dB reduced point, which enabled to distinguish a difference in sounds clearly, was obtained from such a relation, it is evident that the sum of the bendings of the base fabrics is acceptable if it is 36 gf·cm/2.5 cm.

Figure 6:
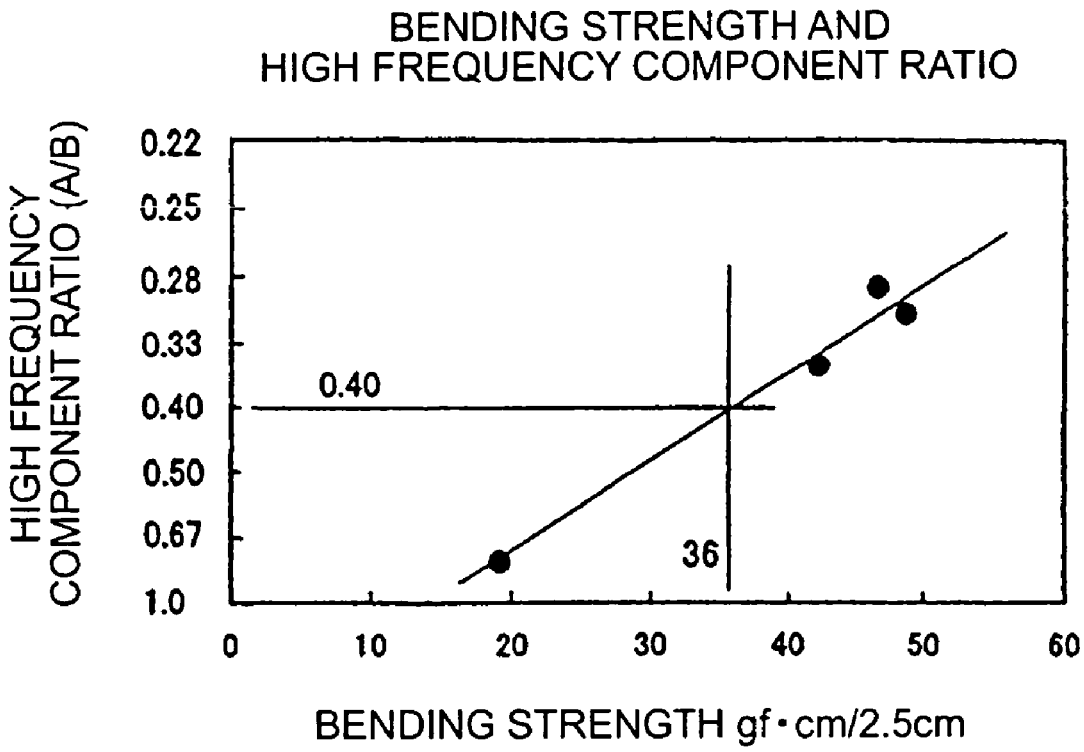
FIG. 6 is a correlation diagram of bending strength of a base fabric and a high frequency component ratio.

Although a main peak of Fourier-transformed spectrum of the sound generated at the time of peeling-off was about 3670 Hz if the bending strength was 46 gf·cm/2.5 cm, it was shifted to a low tone side up to 775 Hz in case of 19 gf·cm/2.5 cm. FIG. 6 indicates that the high frequency component ratio (A/B) is 0.29 in case of 46 gf·cm/2.5 cm while it is 0.67 in case of 19 gf·cm/2.5 cm. Further, it can be considered that a relation between the bending strength and the high frequency component ratio is linear.

When this high frequency component ratio is 0.4, the bending strength is 36 g·cm/2.5 cm. It is evident that no uncomfortable sound is generated when the surface fastener is peeled off if the high frequency component ratio specified by the present invention is 0.4 or more, that is, the bending strength is 36 gf·cm/2.5 cm or less. Further, as understood from FIG. 5, if the bending strength is 36 gf·cm/2.5 cm or less, loudness of the peeling-off sound drops by 10 dB or more with respect to an ordinary product so that it can be felt that the loudness is reduced.

By bending the yarns so as to provide a gap between adjoining yarns, components of a high frequency are attenuated quickly and only components having low frequency remain. Thus, the high frequency in a center is shifted to a side of low frequency. Further, since such base fabric is entirely soft and the elasticity drops, the characteristic vibration is shifted largely to the low frequency side.

To reduce the density of the base fabric, it is effective to roughen the weaving/knitting structure. In case of the knitting structure, providing that a repetitive number (wale density) in a transverse direction is N1 (times/cm) and a repetitive number (course density) in a longitudinal direction is N2(times/cm), if N1+N2 is assumed to be 5.9 or more and 29.0 or less, the structure becomes rough thereby making it possible to reduce the peeling-off sound. In case of the weaving structure, by setting a warp yarn density to 37.5 (pieces/cm) or less, a weft yarn density to 18.0 (pieces/cm) or less, a size of a weft yarn to 140-300 denier, a size of warp yarn to 140-300 denier, and a loop yarn to 450 denier, the structure becomes rough thereby making it possible to reduce the peeling-off sound.

As a method for adjusting bulkiness to reduce the density, it is permissible to use a crimped yarn. The crimped yarn itself has the bulkiness and the woven/knit fabric becomes bulky so that the density drops and the bending strength also drops.

A ratio of storage elastic modulus to loss elastic modulus of a yarn can be improved by mix spinning. Particularly if a yarn of a material having Tan Delta peak near a room temperature such as a urethane fiber is spun mixedly, the loss elastic modulus of the yarn increases remarkably. Further, material whose glass transition point is located at a low temperature and whose crystallinity index is small, like LDPE, is effective. If the loss elastic modulus is raised as described above, the high tone sound can be absorbed effectively so that the sound generated at the time of peeling-off is shifted to the low tone side. Further, if the base fabric is formed of a lace-like organization, yarns for transmitting the vibration are bent in multiple folds and a number of yarns for transmitting the vibration decreases, so that the apparent density drops, which provides a further effective result.

The sound when the surface fastener is peeled off is not originated from only the surface fastener but the vibration is transmitted to a product on which the surface fastener is mounted and the sound is also generated from that product. Thus, no sufficient effect can be expected even if the sound from the surface fastener is reduced and it is necessary to consider a characteristic of the product. Even if the same surface fastener is used, the generated sound differs depending on a mating cloth on which it is sewed. To eliminate such a difference, it is effective to provide a gap between the surface fastener base fabric and cloth so as to provide a structure preventing the vibration from being transmitted to the cloth. Further, it is also effective to place fabric having a feature for softening the sound between them as a spacer. As a spacer, it can be evaluated based on the bending strength like the surface fastener and fabric whose bending strength is 0.7 gf·cm/2.5 cm or less is suitable so that it can plays a role of shifting the vibration to the low frequency side for the same reason as the base fabric of the surface fastener.

Figure 7:
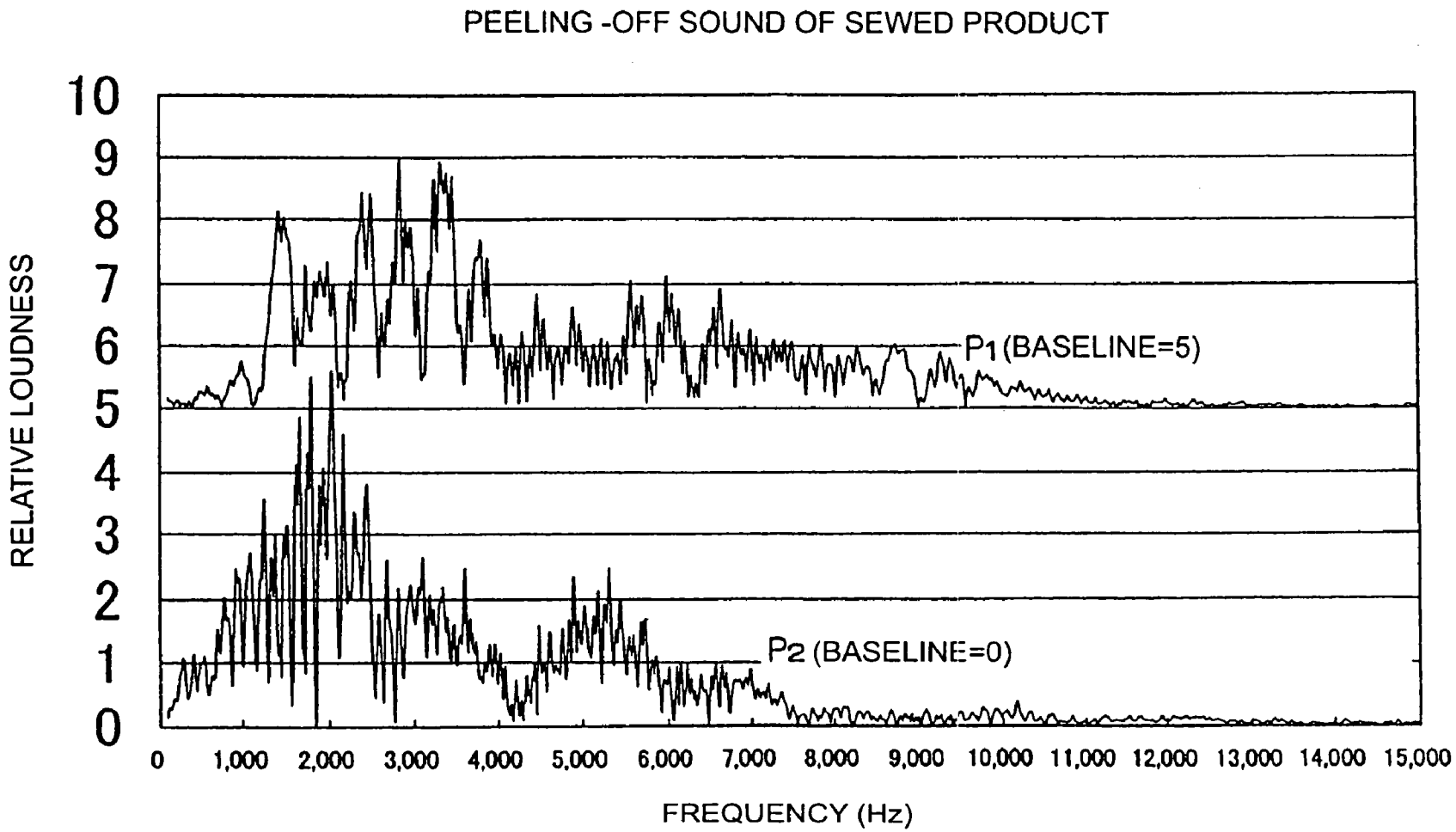
FIG. 7 is an explanatory diagram of relative loudness of a sound generated at a time of peeling-off depending on differences of a attachment structure of a product to which the surface fastener is attached.

FIG. 7 shows a difference between peeling-off sounds when the surface fastener is attached to fabric via a spacer and when it is attached directly to the base fabric. A test piece $P_1$ is a surface fastener whose base fabric is a knit as shown in Table 1 which is attached directly to taffeta fabric and a test piece $P_2$ is the same surface fastener which is attached to taffeta fabric via a spacer. Regarding these test pieces $P_1$, $P_2$, peeling-off sounds were measured according to the above-described method and results are shown as sound spectrum by FFT in FIG. 7. Pile woven fabric whose bending strength was 0.38 gf·cm/2.5 cm was used as a spacer.

As evident from the same Figure, the peeling-off sound of the test piece sewed via the spacer is shifted to the low frequency side. Therefore, the generation of uncomfortable sound at the time of peeling-off is suppressed. The loudness of the sound was 88 dB for the test piece $P_1$ sewed directly to the taffeta fabric (whose bending strength is 0.90 gf·cm/2.5 cm) and that of the test piece $P_2$ sewed to the taffeta fabric via the spacer was 75 dB. Further, the maximum component of the sound spectrum was 3340 Hz for the test piece $P_1$ sewed directly to the taffeta fabric and that was 2200 Hz for the test piece $P_2$ sewed to the taffeta fabric via the spacer. The test piece $P_2$ sewed to the taffeta fabric via the spacer had a low peeling-off sound, which did not provide a feeling of discomfort.

Next, typical examples of the present invention will be described based on specific numeric values.

EXAMPLE 1

A peeling-off sound was measured with a combination of a loop made of knitting-structured base fabric whose bending strength was 12.3 gf·cm/2.5 cm and apparent density was 0.45 g/cm$^3$ and a hook made of weaving-structured base fabric whose bending strength was 6.3 gf·cm/2.5 cm and apparent density was 0.40 g/cm$^3$. The frequency of the maximum component of the peeling-off sound was 700 Hz and the high frequency component ratio was 1.05. This peeling-off sound was low in tone and not unpleasant.

EXAMPLE 2

In a product of a bag made of artificial leather using a surface fastener as a lid stopper, the surface fastener made of knit base fabric whose bending strength was 12.3 gf·cm/2.5 cm and apparent density was 0.45 g/cm$^3$ was used and knit fabric whose bending strength was 0.5 gf·cm/2.5 cm and apparent density was 0.42 g/cm$^3$ was placed between the surface fastener and the artificial leather and sewed. The frequency of the maximum component of a sound generated when the bag lid was opened was about 900 Hz and the high frequency component ratio was 1.3. This sound was extremely lower in tone as compared with a sound generated when the bag lid provided with an ordinary surface fastener was opened and was not unpleasant.

EXAMPLE 3

In golf gloves having a fastening surface fastener at their wrist portions, a female surface fastener member having a loop made of knitting-structured base fabric whose bending strength was 12.3 gf·cm/2.5 cm and apparent density was 0.42 g/cm$^3$ and a male surface fastener member having a hook made of a weaving structure whose bending strength was 6.3 gf·cm/2.5 cm and apparent density was 0.40 g/cm$^3$ were used. Further, a knit fabric whose bending strength was 0.5 gf·cm/2.5 cm and apparent density was 0.35 g/cm$^3$ was placed between each surface fastener and a glove base fabric and sewed together with a sewing machine. The frequency of the maximum component of a peeling-off sound from the surface fastener was 700 Hz. The high frequency component ratio was 0.91 and the peeling-off sound was low in tone and not unpleasant.

Typical examples of the present invention have been described above. The present invention is not limited to these examples, and as evident from the above description, the present invention may be modified in various ways, and for example, the base fabric of the surface fastener, the material and structure of the spacer, the size of the composition fiber and the like can be selected arbitrarily depending on an application within a scope of claims of the present invention.

The invention claimed is:

1. A fiber-made surface fastener comprising joining faces in which a plurality of fiber-made engaging elements are provided on one surface of each flat base fabric, wherein a ratio A/B of an area A of a range in which sound spectrum of a peeling-off sound produced when the joining faces of the surface fastener in an engaged state are peeled off Fourier-transformed in arange of 100 Hz to 15000 Hz is 100 Hz to 3000 Hz to an area B of a range in which sound spectrum of a peeling-off sound produced when the joining faces of the surface fastener in an engaged state are peeled off Fourier-transformed in a range of 100 Hz to 15000 Hz is 3000 Hz to 15000 Hz is 0.4 or more, an apparent density of a base fabric of each of fiber-made surface fastener members which engage each other is 0.5 g/cm$^3$ or less and a joining face of at least one surface fastener member is composed of a plurality of fiber-made engaging elements distributed uniformly on the entire surface of each flat base fabric, and a sum of bending strength of base fabrics of male and female surface fastener members is 36 gf·cm/2.5 cm or less when each base fabric is bent at 180° in a radius of 4.0 mm.

2. The fiber-made surface fastener according to claim 1, wherein the base fabric of the surface fastener has a weaving/knitting structure, and in case of the knitting structure, when a wale density and a course density are N1 (number of wales/cm) and N2 (number of courses/cm) respectively and in case of the weaving structure, densities of warp yarns and weft yarns are N1 (number of warp yarns/cm) and N2 (number of weft yarns/cm) respectively, a following equation (1) is satisfied: $5.9 \leqq N1+N2 \leqq 29$ (1).

3. The fiber-made surface fastener according to claim 1, wherein the base fabric of at least one of the fiber-made surface fastener members which engage each other has a multiple weaving/knitting structure produced by weaving or knitting in multiple layers via a binding yarn while a gap is provided between the respective layers and the apparent density of the base fabric of a remaining one of the surface fastener members is 0.5 g/cm$^3$ or less and the one fiber-made surface fastener member having the multiple weaving/knitting structure comprises one or more layers whose apparent density is 0.5 g/cm$^3$ or less on a rear surface of a base layer from which the engaging elements are raised.

4. A fiber-made surface fastener comprising joining faces in which a plurality of fiber-made engaging elements are provided on any one of front and rear surfaces of each flat base fabric, wherein a maximum component of sound spectrum of a peeling-off sound produced when the joining faces of the surface fastener in an engaged state are peeled off Fourier-transformed in a range of 100 Hz to 15000 Hz is a frequency lower than 3000 Hz, and a sum of bending strength of base fabrics of male and female surface fastener members is 36 g·cm/2.5 cm or less when each base fabric is bent at 180° in a radius of 4.0 mm.

5. The fiber-made surface fastener according to claim 4, wherein the base fabric of the surface fastener has a weaving/knitting structure, and in case of the knitting structure, when a wale density and a course density are N1 (number of wales/cm) and N2 (number of courses/cm) respectively and in case of the weaving structure, densities of warp yarns and weft yarns are N1 (number of warp yarns/cm) and N2 (number of weft yarns/cm) respectively, a following equation (1) is satisfied: $5.9 \leqq N1+N2 \leqq 29$ (1).

6. A fiber-made surface fastener comprising joining faces in which a plurality of fiber-made engaging elements are provided on one surface of each fiat base fabric, wherein a ratio A/B of an area A of a range in which sound spectrum of a peeling-off sound produced when the joining faces of the surface fastener in an engaged state are peeled off Fourier-transformed in a range of 100 Hz to 15000 Hz is 100 Hz to 3000 Hz to an area B of a range in which sound spectrum of a peeling-off sound produced when the joining faces of the surface fastener in an engaged state are peeled off Fourier-transformed in a range of 100 Hz to 15000 Hz is 3000 Hz to 15000 Hz is 0.4 or more, a maximum component of sound spectrum of a peeling-off sound Fourier-transformed in a range of 100 Hz to 15000 Hz is a frequency lower than 3000 Hz, and a sum of bending strength of base fabrics of male and female surface fastener members is 36 gf·cm/2.5 cm or less when each base fabric is bent at 180° in a radius of 4.0 mm.

7. The fiber-made surface fastener according to claim 6, wherein the base fabric of the surface fastener has a weaving/knitting structure, and in case of the knitting structure, when a wale density and a course density are N1 (number of wales/cm) and N2 (number of courses/cm) respectively and in case of the weaving structure, densities of warp yarns and weft yarns are N1 (number of warp yarns/cm) and N2 (number of weft yarns/cm) respectively, a following equation (1) is satisfied: $5.9 \leqq N1+N2 \leqq 29$ (1).

8. A surface fastener attached product provided with a surface fastener according to any one of claims 1 to 6, wherein the ratio A/B of the area A of the range in which the sound spectrum of the peeling-off sound of the surface fastener Fourier-transformed in the range of 100 Hz to 15000 Hz is 100 Hz to 3000 Hz to the area B of the range in which the sound spectrum of the peeling-off sound of the surface fastener Fourier-transformed in the range of 100 Hz to 15000 Hz is 3000 Hz to 15000 Hz is 0.4 or more.

9. The surface fastener attached product according to claim 8, further comprising gap forming means for forming a gap between a rear face of a base fabric from which engaging elements of the surface fastener is raised and an attachment object.

10. The surface fastener attached product according to claim 9, further comprising vibration attenuating means provided between a rear face of a base fabric from which engaging elements of the surface fastener are raised and an attachment object.

11. The surface fastener attached product according to claim 10, wherein the vibration attenuating means is one of various kinds of fabrics whose bending strength is 0.7 gf·cm/2.5 cm or less when the fabric is bent at 180° in a radius of 4 mm.

12. The surface fastener attached product according to claim 10, wherein the vibration attenuating means is one of various kinds of fabrics whose apparent density is 0.5 g/cm$^3$ or less.

* * * * *

UNITED STATES PATENT AND TRADEMARK OFFICE

CERTIFICATE OF CORRECTION

PATENT NO. : 7,475,455 B2
APPLICATION NO. : 10/536474
DATED : January 13, 2009
INVENTOR(S) : Ishibashi et al.

It is certified that error appears in the above-identified patent and that said Letters Patent is hereby corrected as shown below:

Column 10,
Line 65, “arange” should read --a range--.

Column 11,
Lines 20 and 53, the equation should read --$5.9 \leq N1 + N2 \leq 29$ (1).--.

Column 12,
Line 26, the equation should read --$5.9 \leq N1 + N2 \leq 29$ (1).--.

Signed and Sealed this

Twenty-fourth Day of March, 2009

John Doll

JOHN DOLL
*Acting Director of the United States Patent and Trademark Office*